United States Patent [19]

Hasman

[11] 4,134,905

[45] Jan. 16, 1979

[54] TRANS ACID RESTRICTED HARD BUTTERS

[75] Inventor: John M. Hasman, Berea, Ohio

[73] Assignee: SCM Corporation, New York, N.Y.

[21] Appl. No.: 815,158

[22] Filed: Jul. 13, 1977

[51] Int. Cl.[2] ..... C11C 3/12

[52] U.S. Cl. ..... 260/409; 426/313; 426/606; 426/607

[58] Field of Search ..... 260/429; 426/606, 607, 426/313

[56] References Cited

U.S. PATENT DOCUMENTS

| | | | |
|---|---|---|---|
| 2,307,065 | 1/1943 | Paterson | 260/409 |
| 2,972,541 | 2/1961 | Cockran et al. | 260/409 |
| 3,686,240 | 8/1972 | Kawada et al. | 260/409 |

*Primary Examiner*—Winston A. Douglas
*Assistant Examiner*—John F. Niebling
*Attorney, Agent, or Firm*—Jerry K. Mueller, Jr.

[57] ABSTRACT

A non-fractionated, partially hydrogenated, non-lauric glyceride oil product suitable as a hard butter is made by hydrogenating the oil with copper-chromite catalyst to an Iodine Value of about 100-110 followed by hydrogenation with a conventional hydrogenation catalyst, suitably nickel, until hard butter characteristics of the fatty product are achieved.

10 Claims, No Drawings

TRANS ACID RESTRICTED HARD BUTTERS

BACKGROUND OF THE INVENTION

The present invention relates to partially hydrogenated glyceride oil products generally and in particular to a non-fractionated, non-lauric, partially hydrogenated glyceride oil product having the characteristics of a hard butter and suitable as use therefor.

A hard butter is a glyceride oil product which is widely marketed commercially for use in confectionery, dairy and various other edible products. Heretofore, a wide variety of techniques have been proposed for producing hard butters. One such technique is to elaidinize a glyceride oil which typically comprehends partially hydrogenating non-lauric glyceride oils in the presence of a sulfur poisoned nickel catalyst. Another technique is to fractionate and partially hydrogenate various lauric oils such as palm kernel oil. Yet another process is to specially blend various fractions of hard fat, plastic fat and liquid oil until the desired properties of hard butter are achieved. Another process for producing hard butters is to subject the glyceride oil to a random rearrangement of the fatty acid radicals until the characteristics of a hard butter are achieved.

The present process permits a hard butter-type product to be made by a two-step hydrogenation process wherein the trans-oleic acid content of the hard butter product is no more than about 45% and which has a dilatometric profile and Wiley Melting Point consistent with commercial hard butters.

BROAD STATEMENT OF THE INVENTION

The present invention is directed to a process for making a non-fractionated, non-lauric, partially hydrogenated glyceride oil product suitable as a hard butter. Such process comprises subjecting said oil to primary hydrogenation in a primary hydrogenation zone under glyceride oil hydrogenation conditions in the presence of about 0.05% to about 3% copper chromite catalyst until the Iodine Value of said oil is betwen about 100 and 110. The primary hydrogenated oil is subjected to secondary hydrogenation in a secondary hydrogenation zone under glyceride oil hydrogenation conditions in the presence of about 0.001% to about 0.1% nickel hydrogenation catalyst until is produced said product having a Wiley Melting Point of between about 92° and 120° F., no more than about 45% trans-oleic acid content, and having a dilatometric profile characterized by a Solids Fat Index of at least 42 at 80° F., no more than 30 at 92° F., and between 0 and about 15 at 100° F. The Iodine Value of the hard butter product suitably is between about 65 and 75, and preferably between about 65 and 70.

DETAILED DESCRIPTION OF THE INVENTION

Desirable hard butter characteristics vary somewhat depending upon the particular use intended for the hard butter. Predominant uses of hard butters are in dairy products and confectionery products and the present hard butter displays general characteristics making it suitable for both of such uses, though tailoring the instant hard butter for a particular use often is advisable. Additionally, the instant partially hydrogenated glyceride oil product has value as a base stock for fractionation. Z The desired characteristics of the instant hydrogenated oil product suitable as a hard butter include a Wiley Melting Point of about 92° to 120° F., advantageously about 95° to 110° F., and desirably about 95° to 102° F. Also the present hard butter has a dilatometric profile (Solids Fat Index or Solids Content Index vs. temperature) of at least 42 at 80° F., no more than about 30 at 92° F., and between 0 and about 15 at 100° F. Desirably the instant hard butter has a dilatometric profile of about 44 to 48 at 80° F., about 20 to 25 at 92° F., and about 8 to 13 at 100° F. Usually, the instant hard butter has an SFI of at least 60 at 50° F., though no special effort need be extended in order to adhere to this value. The Iodine Value of the present hard butter suitably should be from about 60 to 75, advantageously about 65 to 70, and preferably about 66 to 68.

The unique feature of the instant hard butter product and process for making same is the achievement of the foregoing hard butter characteristics at much lower levels of Trans-oleic acid (elaidic acid) than heretofore possible for non-lauric, non-fractionated hard butters. That is, traditional hard butters contain at least 50 to 55% trans-oleic acid and more often contain about 60% or more trans-oleic acid in order to meet the hard butter characteristics possessed by the instant hard butter as outlined above. Also, most conventional hard butters desirably contain less than about 1% stearic acid, though often this value can range up to about 10% or so.

Though not intending to be bound by theory, it is theorized that the copper chromite catalyst utilized in the present invention causes a bond migration phenomena by promoting migration of double bonds in the fatty acid radicals in the oil from the interior of the chain outwardly to the ends or near the ends of the fatty acid chains. Apparently, positioning of the double bonds nearer to the ends of the fatty acid chains promotes hardness to the resulting product thereby achieving a dilatometric profile characteristic of a hard butter at lower melting points which fall within the desirable hard butter melting point range. Thus, by relying on the selective bond migration, the instant hydrogenated product is suitable as a hard butter at much lower trans-oleic acid content levels than heretofore proposed. Accordingly, the instant process may be practiced by first hydrogenating a glyceride oil with the copper chromite catalyst to cause the foregoing bond migration followed by hardening of the product by a conventional glyceride oil catalyzed hydrogenation step, or the feed oil may be hardened first and then subjected to the action of the copper chromite for obtaining the desirable bond migration.

Typical sources of the feed glyceride oil for the present process include vegetable oils (including nut) such as represented by the oils, for example, soybean, corn, cottonseed, peanut, rapeseed, safflower, sunflower, sesame seed, mixtures thereof and the like. The feed oil for the present process can be conventionally processed by alkali refining, steam refining, deacidified by high vacuum distillation techniques and like conventional practices.

The copper chromite catalyst can be provided in supported or unsupported form for primary hydrogenation. The copper chromite catalyst can be stabilized with an alkaline earth metal oxide, such as barium oxide or calcium oxide, or with a multivalent metal oxide, such as manganese oxide, although this is not essential. Typically, the oxide stabilizing material ranges from about 4% to 8% by weight of the catalyst. The molar ratio of the copper chromite components in the adjunct catalyst also is not critical and such components can be in typical amounts as heretofore conventionally used in the hydrogenation art. Typically, the molar ratio of such components is about 1:1.

In secondary hydrogenation, preferably a nickel hydrogenation catalyst is used. Alternatively, other suitable conventional glyceride oil catalysts such as, for example, nickel copper, Raney nickel, palladium, platinum and the like can be used for this step. Such conventional hydrogenation catalysts can be provided in supported or unsupported form. Typical support materials include alumina, silica gel, activated carbon and the like. Conventional nickel hydrogenation catalysts can be made by thermally decomposing nickel formate or other heat-labile nickel salt and fatty oil at about 425° 450°450° F. or by precipitating the nickel salt on an inert carrier followed by reduction by hydrogen gas. A nickel catalyst also can be prepared by the treatment of electrolytically precipitated nickel hydroxide which may be prepared by passing direct current through a cell using nickel as the anode and using the dilute solution of an alkali salt to the weak acid as an electrolyte. The nickel hydroxide so prepared may be conventionally reduced. The particular manner of preparing a nickel hydrogenation catalyst is not critical to the present invention as the present invention employs those nickel hydrogenation catalysts well known and used in the art today. For present purposes, by nickel catalyst is meant the nickel metal content of such catalyst and the same applies to other conventional hydrogenation catalysts.

Hydrogenation operations for both the nickel and the copper chromite hydrogenation steps comprise charging the glyceride oil product into a hydrogenation reactor having a hydrogenation zone therein. Hydrogenation conditions for contacting hydrogen gas with the oil typically include temperatures of about 100° to about 300° C. and pressures of about 0 to about 100 psig. It can be advantageous on occasion to use lower temperatures and lower pressures during the nickel catalyzed hydrogenation step in order to prevent over hardening of the product and for more precise control of such hydrogenation step. Typical hydrogenation reactors include the hydrogen recirculation type which consists of a cylindrical vessel provided with a hydrogen distributor at the bottom through which an excess quantity of hydrogen gas is blown through the oil in the hydrogenation zone. Another typical hydrogenation reactor is the dead-end system which employs a cylindrical pressure vessel with a mechanical agitator of the gas-dispersion type which is supplied from high pressure hydrogen gas storage tanks at the rate and in the volume actually used and leaked. A variety of other hydrogenation reactors are commonly employed and likewise beneficially hydrogenate the oil.

In the present process hydrogenation in the presence of the copper chromite catalyst, when such step is practiced first is terminated when the Iodine Value of the product is betwen about 100 and 110. When this step follows the nickel hydrogenation step, the partially hardened oil is subjected to the action of the copper chromite catalyst for a time sufficient to obtain the desired characteristics of the hard butter product as heretofore detailed. When the nickel hydrogenation step follows the copper chromite catalyzed hydrogenation step, such hydrogenation is terminated likewise when the characteristics of the hydrogenated product fall within those desired, and often a practical measurement indicia for determining the suitability of the product is to monitor the Iodine Value of the product during nickel hydrogenation.

The present process can be performed batchwise and also advantageously on a continuous basis. In continuous operations, generally the catalyst is separated from the oil following the first hydrogenation step prior to proceeding with the second hydrogenation step. A variety of schemes for accomplishing this on a continuous basis are well known and quite apparent to those skilled in this art.

The following examples show in detail how the present invention can be practiced, but should not be construed as limiting the scope of the present invention. In this application, all percentages and proportions are by weight, all temperatures are in degrees Fahrenheit unless expressly otherwise noted, and all catalyst weight percentages are based on the weight in a zone of the oil subjected to hydrogenation.

EXAMPLES

The feed oil for the examples was from a batch of alkali-refined soybean oil having the following analysis:

| | |
|---|---|
| Iodine Value | 136.2 |
| Free Fatty Acid | 0.06% |
| Iron | 0.25 ppm |
| Phosphatides | 4.0 ppm |
| Water | 0.06% |
| Soap (as sodium oleate) | 0.11% |
| Color | 4.9R-50Y |

| FATTY ACID CONTENT (Chain length: no. of double bonds) | Weight-Percent |
|---|---|
| C14:0 | 0.1 |
| C15:0 | trace |
| iso C16:0 | trace |
| C16:0 | 11.1 |
| C16:1 | 0.2 |
| C17:0 | 0.2 |
| iso C18:0 | trace |
| C18:0 | 3.8 |
| C18:1 | 21.4 |
| C18:2 | 53.9 |
| C18:3 | 8.7 |
| C20:0 | 0.4 |
| C22:0 | 0.2 |

Two lots of the foregoing soybean oil were hydrogenated according to the precepts of the present invention. The conditions for each hydrogenation stage for each of the two runs is given below.

| PRIMARY HYDROGENATION CONDITIONS | RUN 1 | RUN 2 |
|---|---|---|
| Copper Chromite (wt-%) | 1.0% | 1.0% |
| Temperature (° C) | 222° | 220° |
| $H_2$ Pressure | 60 psig | 60 psig |
| Time | 7.25 hrs | 7.75 hrs |
| Intermediate IV | 106.5 | 104.9 |
| **SECONDARY HYDROGENATION CONDITIONS** | **RUN 1** | **RUN 2** |
| Nickel (wt-%) | 0.057% | 0.05% |
| Temperature (° C) | 220° | 220° |
| $H_2$ Pressure | 15 psig | 15 psig |
| Time | 0.5 hrs | — |

The partially hydrogenated product (hard butter) withdrawn from the secondary hydrogenation stage was analyzed and found to have the following composition and characteristics.

| FATTY ACID COMPOSITION (Chain length: no. of double bonds) | RUN 1 (wt-%) | RUN 2 (wt-%) |
|---|---|---|
| C14:0 | 0.1 | 0.1 |
| C16:0 | 11.2 | 10.9 |
| C17:0 | 0.1 | 0.1 |
| iso C18:0 | 0.1 | 0.1 |
| C18:0 | 14.8 | 12.8 |
| C18:2 | 69.8 | 72.3 |
| C18:3 | — | 0.1 |
| C20:0 | 0.3 | 0.3 |
| C22:0 | — | 0.4 |
| IODINE VALUE | 66.3 | 67.4 |
| % trans-oleic acid | 46.7% | 44.8% |
| Wiley Melting Point (° F) | 109.0° | 106.6° |

| DILATOMETRIC PROFILE | | |
|---|---|---|
| TEMPERATURE (° F) | RUN 1 (Solids Fat Index) | RUN 2 (Solids Fat Index) |
| 50° | 64.7 | 62.2 |
| 70° | 52.9 | 49.4 |
| 80° | 47.9 | 43.0 |
| 92° | 28.6 | 22.6 |
| 100° | 13.3 | 9.1 |
| 110° | 0.1 | 0 |

Previous testing had indicated that a trans-oleic acid content of about 55%, for example, would be required to produce a similar metling point and dilatometric profile as displayed by the hard butter of Run 1. The hard butters of the above two runs, and especially the hard butter of Run 2, have characteristics within the range of specifications typically required of a hard butter. Refinement and tailoring of the characteristics of the present hard butter for particular uses wisely can be practiced of course.

I claim:

1. A process for making a non-fractionated, non-lauric, partially hydrogenated glyceride oil product suitable as a hard butter which comprises:

(a) subjecting said oil to primary hydrogenation in a primary hydrogenation zone under glyceride oil hydrogenation conditions in the presence f about 0.05% to about 3% by weight copper chromite catalyst until the Iodine Value of said oil is between about 100 and 110; and (b) subjecting said primary hydrogenated oil to secondary hydrogenation in a secondary hydrogenation zone under glyceride oil hydrogenation conditions in the presence of about 0.001 to about 0.1% by weight nickel hydrogenation catalyst until is produced said product having a Wiley Melting Point of between about 92.20 and 120° F, no more than about 45% trans-oleic acid content, and a Solids Fat Index of at least about 42 at 80° F, no more than about 30 at 92° F, and between 0 and about 15 at 100° F.

2. The process of claim 1 wherein said product has an Iodine Value of between about 65 and 70.

3. The process of claim 2 wherein said Iodine Value is between about 66 and 68.

4. The process of claim 1 wherein said product has a Solids Fat Index of about 44 to 48 at 80° F., about 20 to 25 at 92° F., and about 8 to 13 at 100° F.

5. The process of claim 1 wherein said product has a Wiley Melting Point of between about 95° and 110° F.

6. The process of claim 1 wherein said Wiley Melting Point is between about 95° and 102° F.

7. The process of claim 1 wherein said product contains no more than about 40% trans-oleic acid.

8. The product of the process of claim 1.

9. A process for making a non-fractionated, non-lauric, partially hydrogenated glyceride oil product suitable as a hard butter which comprises:

(a) subjecting said oil to hydrogenation in a hydrogenation zone under glyceride oil hydrogenation conditions in the presence of about 0.001 to about 0.1% by weight nickel hydrogenation catalyst until the Iodine Value of said oil is between about 65 and 75; and (b) subjecting said oil from step (a) to hydrogenation in a hydrogenation zone under glyceride oil hydrogenation conditions in the presence of about 0.05% to about 3% by weight copper chromite catalyst until said product is formed having a Wiley Melting Point of between about 92° and 120° F., no more than about 45% trans-oleic acid content, and a Solids Fat Index of at least about 42 at 80° F., no more than about 30 at 92° F., and between 0 and about 15 at 100° F.

10. The process of claim 9 wherein the Iodine Value of said product is between about 65 an 70.

* * * * *

UNITED STATES PATENT AND TRADEMARK OFFICE

CERTIFICATE OF CORRECTION

PATENT NO. : 4,134,905

DATED : Jan. 16, 1979

INVENTOR(S) : John M. Hasman

It is certified that error appears in the above–identified patent and that said Letters Patent are hereby corrected as shown below:

Under References Cited, U.S. PATENT DOCUMENTS, change "Cockran et al." to read --Cochran et al.--.

Col. 1, l. 68, delete "Z".

Col. 3, l. 18, change "450°450°F." to --or 450°F.--.

Col. 5, l. 10, delete the portion of the table reading

| | | |
|---|---|---|
| "C18:2 | 69.8 | 72.3" |

and insert therefor

| | | |
|---|---|---|
| --C18:1 | 69.8 | 72.3 |
| C18:2 | 3.6 | 2.8--; |

l. 44, in claim 1, change "f" after "presence" to --of--.

Col. 6, l. 7, in claim 1, change "92.20" to --92°--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*